US005394231A

United States Patent [19]

Sudo et al.

[11] Patent Number: 5,394,231

[45] Date of Patent: Feb. 28, 1995

[54] IMAGE FORMING APPARATUS CAPABLE OF FORMING AN ERASABLE IMAGE

[75] Inventors: Kazuhisa Sudo, Kawasaki; Mitsuo Tanaka; Chikara Imai, both of Tokyo; Koji Suzuki, Yokohama; Norimasa Sohmiya, Souka; Sadao Takahashi, Tokyo, all of Japan

[73] Assignee: Ricoh Company, Ltd., Tokyo, Japan

[21] Appl. No.: 99,553

[22] Filed: Jul. 30, 1993

[30] Foreign Application Priority Data

Jul. 31, 1992 [JP] Japan ..... 4-205663
Nov. 9, 1992 [JP] Japan ..... 4-298613

[51] Int. Cl.[6] ..... G03G 15/01

[52] U.S. Cl. ..... 355/326 R; 430/45; 430/120; 503/201

[58] Field of Search ..... 355/326 R, 327, 328, 355/245, 246; 430/109, 106.6, 904, 45, 120, 105–108; 503/201, 204, 216–217, 225, 226; 118/645, 653

[56] References Cited

U.S. PATENT DOCUMENTS

| | | | |
|---|---|---|---|
| 4,532,200 | 7/1985 | Arney et al. | 430/138 |
| 4,599,630 | 7/1986 | Ohtaki et al. | 346/204 |
| 4,620,204 | 10/1986 | Inaba et al. | 346/204 |
| 4,734,735 | 3/1988 | Haneda | 355/326 X |
| 5,045,420 | 9/1991 | Hosono et al. | 430/45 |
| 5,234,783 | 8/1993 | Ng | 430/45 |
| 5,296,439 | 3/1994 | Maruyama et al. | 503/201 |

*Primary Examiner*—A. T. Grimley
*Assistant Examiner*—T. A. Dang
*Attorney, Agent, or Firm*—Oblon, Spivak, McClelland, Maier, & Neustadt

[57] ABSTRACT

An image forming apparatus capable of forming both of erasable images and images to be stored, and increasing the number of times that a single sheet with an image can be repetitively decolorized and reused. The apparatus includes a photoconductive element for electrostatically forming a latent image representative of image data. A developing device develops the latent image formed on the photoconductive element by either of an ordinary undecolorizable toner and a decolorizable toner.

10 Claims, 5 Drawing Sheets

IMAGE FORMING APPARATUS CAPABLE OF FORMING AN ERASABLE IMAGE

BACKGROUND OF THE INVENTION

The present invention relates to an image forming apparatus capable of forming an erasable image and, more particularly, to an image forming apparatus for forming an image on a sheet by a decolorizable toner.

There has recently been reported a decolorizable toner which becomes transparent when illuminated, heated or otherwise treated. For example, a toner in which a functional infrared absorptive coloring matter IR820B and ammonium salt of organic boron, e.g., tetrabutyl ammoniumbutyl triphenylborate are coexistingly dispersed is taught in "Functional Coloring Matter Sectional Meeting, Data No. 17", Functional Coloring Matter Sectional Meeting of the Kinki Institute of Chemical Engineers, May 29, 1991. A decolorizable toner reactive to light appears blue before decolorization and exhibits the maximum absorption for a wavelength of 825 nm. When illuminated by infrared rays having a wavelength range close to 825 nm or light containing such infrared components (e.g. light from a halogen lamp), the decolorizable toner becomes transparent. Therefore, by decolorizing a decolorizable toner image existing on a sheet, it is possible to use the sheet repetitively. This effectively saves limited natural resources. Let the toner made transparent by decolorization be referred to as a transparent toner hereinafter.

The decolorizable toner becomes transparent when subjected to light or heat. Hence, when a sheet carrying a toner image formed by a decolorizable toner sensitive to light is left in a light place, the toner image sequentially fades and, finally, becomes transparent. Also, a decolorizable toner image sensitive to heat becomes transparent when stored in a hot place. For this reason, the decolorizable toner is not feasible for images containing important data. It follows that if an image forming apparatus is operable only with a decolorizable toner, images to be stored have to be formed by another and exclusive image forming apparatus.

Moreover, although decolorization makes a decolorizable toner forming a toner image on a sheet transparent, it does not remove the toner image from the sheet; that is, the transparent toner image remains on the sheet even after decolorization. As a result, the amount of transparent toner the remaining on the sheet sequentially increases as the sheet is repetitively used, resulting in various problems, as follows. When a toner image is to be transferred to the sheet by a new image forming step, the transparent toner remaining on the sheet causes the image to be irregularly transferred, locally lost, or otherwise damaged. Further, the sheet with the transparent toner remaining thereon is apt to jam the transport path. In addition, in the event of fixation, hot offset or similar defects may occur. Therefore, despite decolorization, the number of times that a single sheet can be repetitively used is limited. Generally, the maximum number of repetitive use of a single sheet is considered to be 10 times at most.

SUMMARY OF THE INVENTION

It is therefore an object of the present invention to provide an image forming apparatus capable of forming both of erasable images and images which should be stored.

It is another object of the present invention to provide an image forming apparatus capable of increasing the number of times that a single sheet with a decolorizable toner image can be decolorized and reused.

An image forming apparatus capable of forming an erasable image of the present invention comprises a photoconductive element for electrostatically forming a latent image representative of image data, and a developing device for developing the latent image formed on the photoconductive element by either of an ordinary undecolorizable toner and a decolorizable toner.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
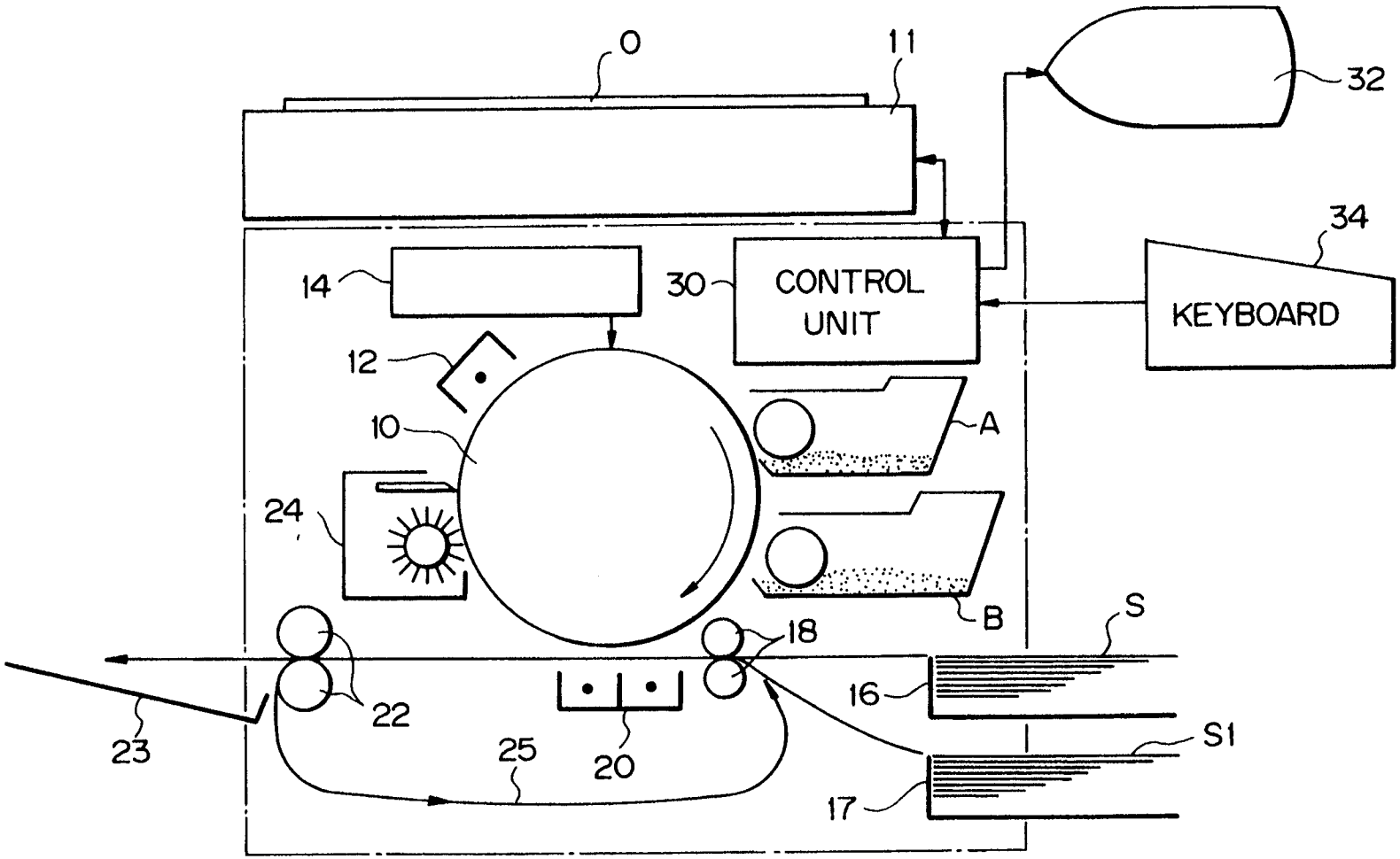
FIG. 1 is a section showing an image forming apparatus embodying the present invention.

Referring to FIG. 1 of the drawings, an image forming apparatus embodying the present invention is shown and implemented as a digital electronic copier. As shown, the copier has a photoconductive element in the form of a drum 10, a document reading device 11, a charger 12, an optical scanning device 14, developing units A and B, sheet cassettes 16 and 17 loaded with sheets tacks S and S1, respectively, a registration roller pair 18, an image transfer and sheet separation unit 20, a fixing unit 22, a tray 23, a cleaning unit 24, a sheet transport path 25, a control unit 30, a VDT 32, and a keyboard 34. Labeled O in the figure is an original document.

The drum 10 is rotated in a direction indicated by an arrow in FIG. 1. The charger 12 uniformly charges the surface of the drum 10 during an image forming process. The reading device 11 reads the document O by decomposing the image data of the document O into pixel data and can be implemented by a conventional arrangement. Comprising a computer, the control unit 30 stores the image data generated by the reading device 11 in a memory thereof and can display them on the VDT 32 when instructed on the keyboard 34.

The scanning device 14 scans the charged surface of the drum 10 with a light beam to write the image data stored in the memory thereon, as has been customary with, e.g., an optical printer. As a result, a latent image corresponding to the document image is electrostatically formed on the drum 10.

The developing unit A stores an optically or otherwise decolorizable toner for developing the latent image formed on the drum 10. On the other hand, the developing unit B stores an ordinary toner for developing the latent image. When one of the developing units A or B is selected, the other is held in an inoperative state.

The sheets S stacked in the cassette 16 are sheets whose toner images were decolorized for reuse, i.e., regenerated sheets. The sheets S1 stacked on the cassette 17 are fresh sheets. Either of the cassettes 16 and 17 is selected when an image forming process is to be executed. When one of the cassettes 16 and 17 is empty, the other cassette is automatically selected. Such automatic cassette selection is stored in the control unit 30 as a control program.

The registration roller pair 18 stops the sheet selectively fed from the cassette 16 or 17 and then drives it toward an image transfer station at a predetermined timing. Located at the image transfer station, the image transfer and sheet separation unit 20 transfers the toner image formed on the drum 10 to the sheet and then separates the sheet from the drum 10. The fixing unit 22 fixes the toner image on the sheet by heat. The cleaning unit 24 removes the toner remaining on the drum 10 after the image transfer.

Figure 2A:
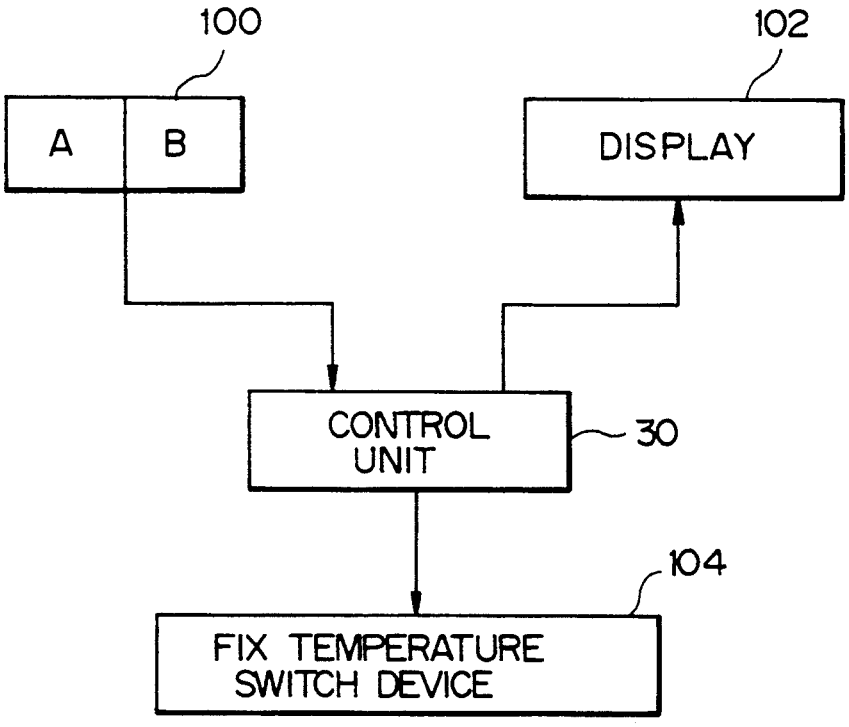
FIGS. 2A and 2B are block diagrams schematically showing a control system incorporated in the embodiment.

The embodiment allows a desired toner to be selected and changes fixing temperature, as follows. FIG. 2 shows a switch 100 accessible for selecting either of the two developing units A and B, and a display 102. The switch 100 and display 102 both are arranged on an operation board provided on the copier body. When the switch 100 is operated to select the developing unit A or B, the result of selection is sent to the control unit 30 which then shows it on the display 102. For example, when the developing unit A, storing the decolorizable toner is selected, a message indicating it, e.g., "Developing unit A" appears on the display 102. On the basis of the selection, the control unit 30 causes a temperature switching device 104 to set a fixing temperature lower than a fixing temperature assigned to an image forming process to be executed with the ordinary toner.

Figure 2B:
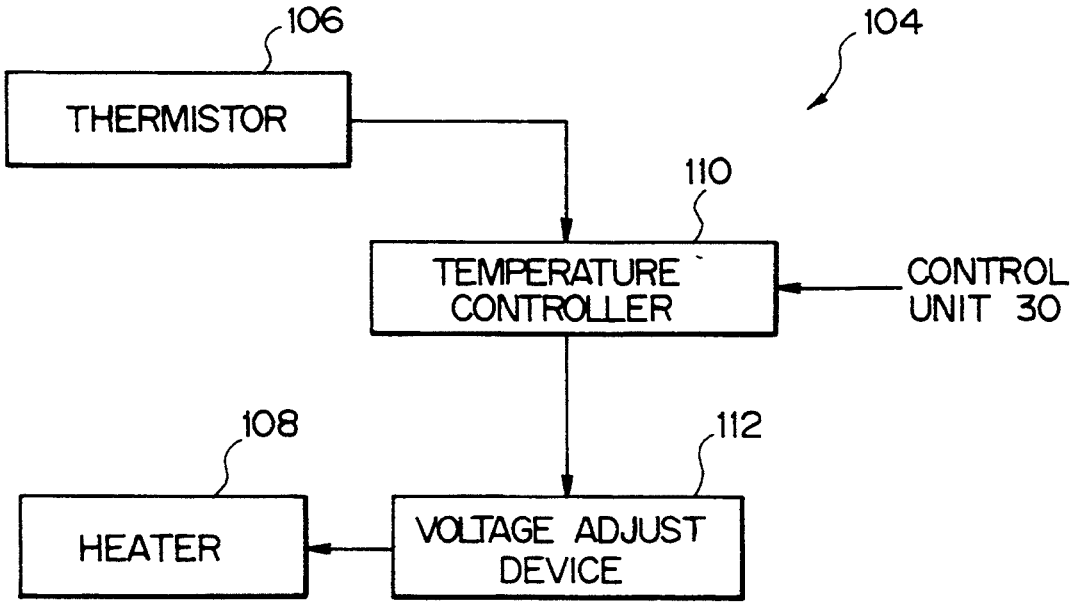

FIG. 2B shows a specific construction of the temperature switching device 104. As shown, the device 104 has a thermistor 106 for sensing the surface temperature of a fixing roller, not shown, a heater 108 disposed in the fixing roller, a temperature controller 110, and a voltage adjusting unit 112. The surface temperature of the fixing roller, i.e., fixing temperature sensed by the thermistor 106 is applied to the temperature controller 110. The temperature controller 110 selects either of a high and a low fixing temperature set therein beforehand. Specifically, when the ordinary toner is used to fix a toner image, the controller 110 selects the high fixing temperature; when the decolorizable toner is used, it selects the low fixing temperature. The controller 110 compares the actual temperature of the fixing roller sensed by the thermistor 106 and the fixing temperature selected and feeds a signal proportional to their difference to the voltage adjusting unit 112. In response, the adjusting unit 112 changes the amount of heat to be generated by the heater 108. In this manner, the surface temperature of the fixing roller, or fixing temperature, is brought to the set temperature by feedback control.

When development using the decolorizable toner is selected, the developing unit A develops the latent image formed on the drum 10 by the decolorizable toner to produce a toner image. The toner image is transferred to the sheet S or S1. The fixing unit 22 fixes the toner image on the sheet S or S1 at the low fixing temperature while reducing curls, creases and other stresses to act on the sheet as far as possible. This subjects the sheet S or S1 to a minimum of damage in the fixing step and extends the maximum service life of the sheet from the conventional ten times of repetitive use to fifteen to twenty times of repetitive use.

Figure 3:
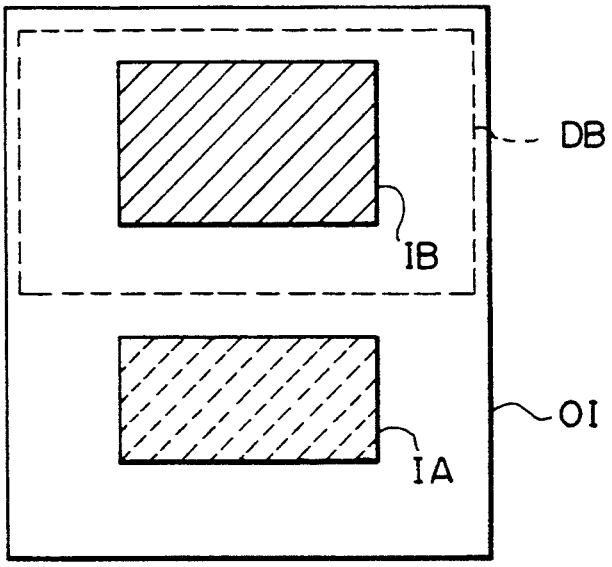
FIG. 3 is a view demonstrating image formation available with the embodiment.

How the embodiment forms an image will be described with reference to FIG. 3. In FIG. 3, labeled OI is a document image read by the reading device 11 and appearing on the VDT 32. Assume that the document image OI includes repetitively usable image data IB, e.g., format data, and decolorizable image data IA. Then, the keyboard 34, FIG. 1, is operated to mark an area DB as an image area to be developed by the ordinary toner. The document area other than the area DB is entered as an image area to be developed by the decolorizable toner. In this sense, the reading device 11, control unit 30, VDT 32 and keyboard 34 constitute marking means.

Referring again to FIG. 1, as the image areas are entered on the keyboard 34 as stated above, the control unit 30 renders the developing unit B operable, rotates the drum 10 to charge it, and controls the scanning device 14 to write a latent image representative of the image lying in the marked area DB, FIG. 3, on the drum 10. Subsequently, the developing unit B develops the latent image by the ordinary toner. The resulting toner image is transferred to the sheet S or S1 and then fixed by the fixing unit 22. In this case, the high fixing temperature is selected. The sheet S or S1 carrying the fixed toner image thereon is returned to the registration roller pair 18 via the transport path 25. The drum 10 is cleaned by the cleaning unit 24 and then charged by the charger 12 again. In this condition, the scanning device 14 forms a latent image representative of the image data lying outside of the marked area DB on the charged surface of the drum 10. At this instant, the control unit 30 renders the developing unit A operable in place of the developing unit B. The latent image is developed by the developing unit A storing the decolorizable toner. The resulting toner image, i.e., decolorizable toner image is transferred to the sheet S or S1 while being accurately positioned relative to the toner image formed by the ordinary toner previously. This toner image is also fixed on the sheet S or S1 by the fixing unit 22. In this case, the low fixing temperature is selected.

Figure 4:
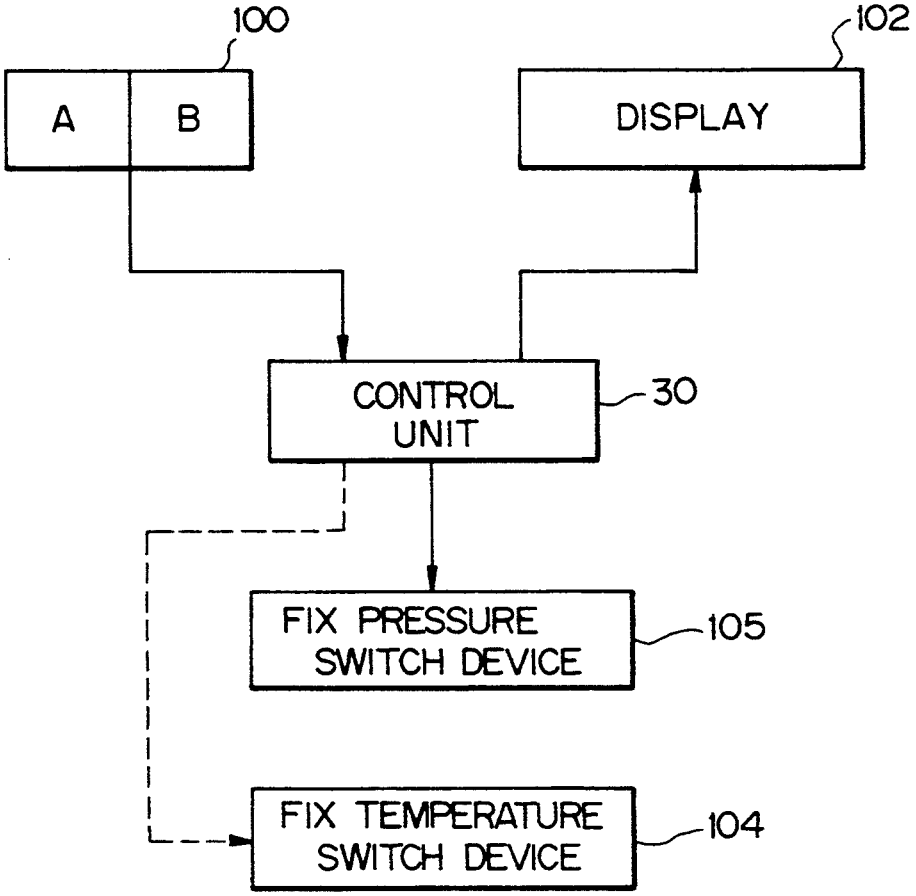
FIG. 4 is a block diagram schematically showing an alternative control system of the embodiment.

A modified form of the illustrative embodiment will be described with reference to FIGS. 1 and 4. As shown in FIG. 4, the control unit 30 controls a fixing pressure switching device 105 on the basis of the toner selected, thereby changing a fixing pressure. At the same time, the control unit 30 may control the fixing temperature switching device 104 to change the fixing temperature also, as indicated by a dashed line in FIG. 4. The temperature switching device 104 may be implemented by the arrangement shown in FIG. 2B. It is to be noted that when both of the fixing pressure and fixing temperature are controlled, the fixing temperature does not have to be so low.

Figure 5:
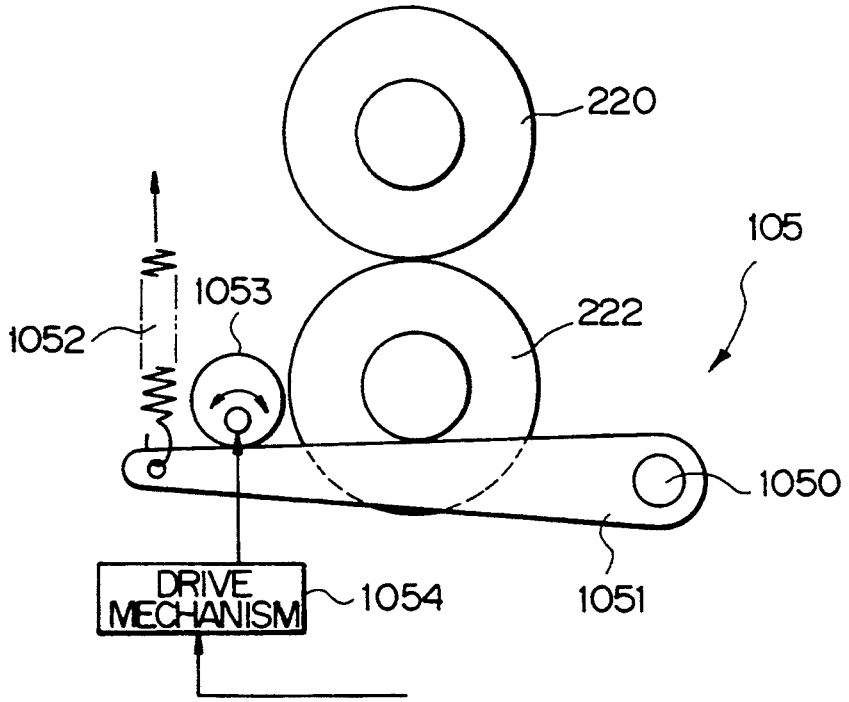
FIG. 5 is a view showing a specific form of a fixing pressure switching device shown in FIG. 4.

Referring to FIG. 5, a specific construction of the fixing pressure switching device 105 is shown. As shown, a fixing roller 220 is rotatably supported by a stationary member, not shown. A pressing roller 222 is movable in the up-and-down direction, as viewed in the figure, and pressed against the fixing roller 220 by a predetermined fixing pressure in the axial direction thereof. A mechanism for so pressing the roller 222 against the roller 220 has a lever 1051 rotatably supported by a stationary member 1050, and a spring 1052 anchored to the free end of the lever 1051 at one end and to a stationary member, not shown, at the other end. The spring 1052, therefore, constantly biases the lever 1051 in the clockwise direction. In this configuration, the pressing roller 222 is pressed against the fixing roller 220 by a predetermined pressure. An eccentric cam 1053 is held in contact with the upper edge of the lever 1051 in the vicinity of the free end of the lever 1051 and rotated by a drive mechanism 1054. FIG. 5 represents a condition wherein the developing device B is selected; in this case, a high fixing pressure is set up.

To switch the high fixing pressure to a low fixing pressure, the control unit 30 sends a control signal to the drive mechanism 1054. In response, the drive mechanism 1054 rotates the eccentric cam 1053 so as to rotate the lever 1051 counterclockwise. As a result, the bias urging the pressing roller 222 upward is reduced to set up the low fixing pressure.

Figure 6:
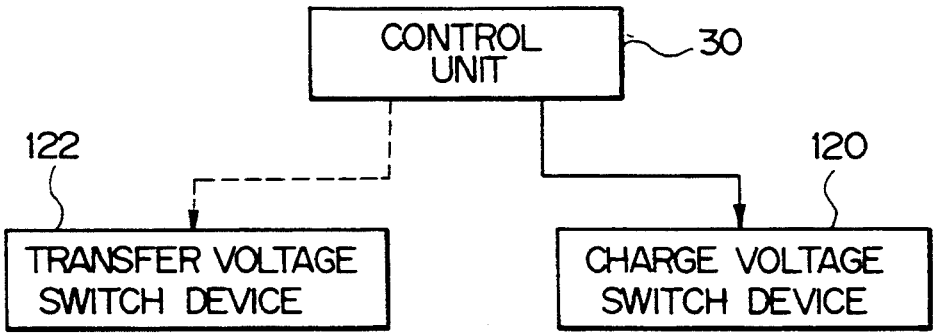
FIG. 6 is a block diagram schematically showing another alternative control system of the embodiment.

Referring to FIG. 6, the controller 30 controls a charge voltage switching device 120 which in turn controls the voltage to be applied to the charger 12. Specifically, when development using the decolorizable toner is selected, the controller 30 causes the charge voltage switching device 120 to apply a low voltage to the charger 12. The low voltage lowers the potential of a latent image with the result that the amount of decolorizable toner to deposit on the drum 10, FIG. 1, is reduced. Consequently, the toner image produced by the decolorizable toner is lower in density than the toner image produced by the ordinary toner. Alternatively, the controller 30 may control a transfer voltage switching device 122 to lower a transfer voltage when development using the decolorizable toner is selected. The lowered transfer voltage will lower the transfer efficiency and, therefore, the amount of decolorizable toner to deposit on the sheet. This is also successful in reducing the density of the toner image. Since the amount of decolorizable toner forming the toner image is small, the amount of transparent toner to remain on the sheet after decolorization is also small. Hence, a single sheet can be repetitively used fifteen to twenty times, which is a remarkable improvement over the conventional service life.

Figure 7:
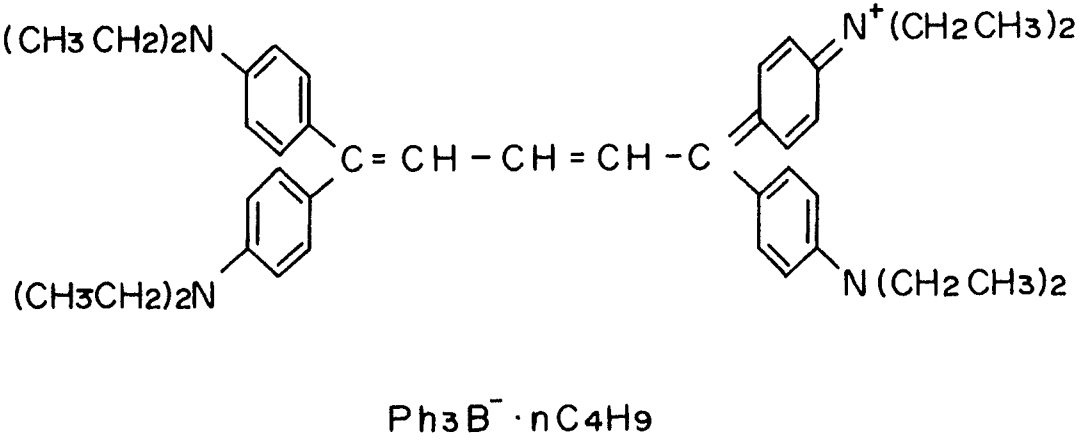
FIG. 7 shows the structural formula of a coloring matter applicable to a decolorizable toner.

FIG. 7 shows the structural formula of a coloring matter applicable to the decolorizable toner.

In summary, it will be seen that the present invention provides a new and useful image forming apparatus capable of selectively forming important images needing storage or images which may be erased. Moreover, the apparatus allows a single sheet to be repetitively used a number of times since a sheet suffers from only a minimum of damage when an image formed by a decolorizable toner is fixed and since the amount of decolorizable toner to deposit on a sheet in each image formation is small. In addition, the apparatus allows format data or similar repetitively usable data to be formed by an ordinary toner and allows additional data, which may be erased, to be formed by a decolorizable toner. Hence, format data and other similar data can be repetitively used.

Various modifications will become possible for those skilled in the art after receiving the teachings of the present disclosure without departing from the scope thereof. For example, the present invention is practicable not only with the digital electronic copier shown and described, but also with a copier of the type forming a latent image by projecting a document image. Developing units storing an ordinary color and a decolorizable toner, respectively, may be selectively mounted on the apparatus body. In such a case, the developing unit storing the decolorizable toner may be provided with an actuating portion for turning on a switch provided on the apparatus body. Then, the switch will automatically indicate that the developing unit storing the decolorizable toner is mounted on the apparatus body.

What is claimed is:

1. An image forming apparatus capable of forming an erasable image, comprising:

a photoconductive element for electrostatically forming a latent image representative of image data; and a developing device for developing latent image formed on said photoconductive element by an ordinary undecolorizable toner and a decolorizable toner, wherein a density of said decolorizable toner formed on said photoconductive element is less than a density of said undecolorizable toner formed on said photoconductive element, said decolorizable toner defined by a toner which has a visible color when said latent image is formed and transparent when treated.

2. An apparatus as claimed in claim 1, wherein said developing device comprises a first developing unit storing the undecolorizable toner, and a second developing unit storing the decolorizable toner.

3. An apparatus as claimed in claim 2, further comprising selecting means for selecting either of said first developing unit and said second developing unit.

4. An apparatus as claimed in claim 3, wherein said selecting means comprises a switch provided on an operation board of said apparatus.

5. An apparatus as claimed in claim 3, further comprising displaying means for displaying one of said first developing unit and said second developing unit selected by said selecting means.

6. An apparatus as claimed in claim 3, further comprising a transferring device for transferring a developed toner image to a sheet, and a fixing device for fixing the transferred toner image on said sheet.

7. An apparatus as claimed in claim 6, further comprising temperature setting means for selecting a high fixing temperature for said fixing device when said first developing unit is selected and a low fixing temperature for said fixing device when said second developing unit is selected.

8. An apparatus as claimed in claim 6, further comprising pressure setting means for selecting a high fixing pressure for said fixing device when said first developing unit is selected and a low fixing pressure for said fixing unit when said second developing unit is selected.

9. An apparatus as claimed in claim 6, further comprising density setting means for selecting a high density for an image to be formed on a sheet when said first developing unit is selected and a low density for said image when said second developing unit is selected.

10. An apparatus as claimed in claim 6, further comprising:

allowing an operator to mark means for marking a desired area of an image to be formed on a sheet; and marked latent image forming means for selectively electrostatically forming a first latent image corresponding to an image portion lying in the desired area or a second latent image corresponding to an image portion lying outside of the said desired area;

said apparatus developing one of the first and second latent images by the undecolorizable toner of said first developing unit, and developing the other latent image by the decolorizable toner of said second developing unit.

* * * * *